US007278664B2

(12) United States Patent
Su et al.

(10) Patent No.: US 7,278,664 B2
(45) Date of Patent: Oct. 9, 2007

(54) FASTENER WITH LATERAL FASTENING MECHANISM

(75) Inventors: Tsui-Jung Su, Hsin-Tien (TW); Chia-Hsin Hsu, Hsin-Tien (TW); Yun-Chen Chen, Hsin-Tien (TW)

(73) Assignee: Zippy Technology Corp., Hsin-Tien, Taipei Hsien (TW)

( * ) Notice: Subject to any disclaimer, the term of this patent is extended or adjusted under 35 U.S.C. 154(b) by 0 days.

(21) Appl. No.: 11/129,373

(22) Filed: May 16, 2005

(65) Prior Publication Data

US 2006/0255599 A1 Nov. 16, 2006

(51) Int. Cl.
*E05C 19/00* (2006.01)

(52) U.S. Cl. ..... 292/304; 292/341.15; 292/DIG. 4

(58) Field of Classification Search ..... 292/341.15, 292/DIG. 4, 304
See application file for complete search history.

(56) References Cited

U.S. PATENT DOCUMENTS 5,090,751 A * 2/1992 Kobayashi ..... 292/71
5,217,262 A * 6/1993 Kurosaki ..... 292/6
5,984,381 A * 11/1999 Yamagishi ..... 292/45
6,869,114 B2 * 3/2005 Ueki ..... 292/341.17

FOREIGN PATENT DOCUMENTS

TW 568197 12/2003

* cited by examiner

*Primary Examiner*—Gary Estremsky
(74) *Attorney, Agent, or Firm*—Birch, Stewart, Kolasch & Birch, LLP

(57) ABSTRACT

The present invention discloses a fastener with lateral fastening mechanism, including an outer case, a slide block, a claw-shaped head, and a flexible member. The outer case is a hollow tubular member. A swing lever is pivotally connected inside the outer case. The slide block can move freely to a first position where the slide block is hidden inside the outer case, and to a second position where the slide block sticks out of the outer case. One end of the slide block is pivotally connected to the claw-shaped head, and the flexible member can constantly provide force for pushing the claw-shaped head and the slide block. A guide area of the slide block can interact with the swing end of the swing lever, and in the state of interaction, the position of the slide block can be decided to be either at the first position or the second position.

15 Claims, 10 Drawing Sheets

FASTENER WITH LATERAL FASTENING MECHANISM

FIELD OF THE INVENTION

The present invention relates to a fastener and, more particularly, to a fastener with lateral fastening mechanism suitable for fastening an object from its lateral side.

BACKGROUND OF THE INVENTION

The basic function of a fastener is to join two devices, or to release one of the devices through simple operation. The mechanism of a fastener is often applied to an object such as a door or, more specifically, a door used as an operation panel for house appliance. Conventional fasteners are varied in designs, and their operating methods are very different as a result. In general, a common fastener often employs press operation as its actuation method, in which the first press action means a linking function, whereas the second press action means a releasing function.

A clamp-style fastener is disclosed in R.O.C. Patent Publication No. 568197, which includes a fixed body and a sliding body, wherein the fixed body includes a U-shaped flexible actuating lever and a spring, located at the bottom of the accommodation slot of the fixed body, whereas the sliding body includes an actuating panel capable of making sliding movement inside the accommodation slot. Besides, the actuating lever includes two hanging terminals that are facing oppositely to each other and capable of making mutual interaction between themselves and the protruding blocks at the two sides of actuating panel of the sliding body through resilience generated by the spring. By means of such interaction, the sliding body can remain at a certain position and thus complete a press operation of the fastener.

In FIGS. 11–14 that are drawings of the aforementioned prior art, another fastener design is also disclosed, which is a clamp-style fastener with a case body and a clamping component capable of making free sliding movement inside the case body. The mechanism of this prior invention is to perform clamping function of a clamping component that carries out clamping momentum when the clamping component is sliding into the case body.

SUMMARY OF THE INVENTION

The present invention provides a fastener with lateral fastening mechanism, capable of fastening or unfastening an object from the lateral side of the object, and especially suitable for an object that cannot be fastened from its ends.

According to one embodiment of the present invention, the disclosed fastener with lateral fastening mechanism includes an outer case, a slide block, a claw-shaped head, and a flexible member, wherein the outer case is a hollow tubular member, with one end closed and the other end open, allowing the slide block to make free in-and-out movement from the open end; also, a pivotally-connected swing lever is provided inside the outer case; the slide block can make sliding movement inside the outer case in such a way that one movement can go to a first position where the slide block can be hidden inside the outer case, and another movement to a second position where the slide block can stick out from the outer case; besides, one end of the slide block is pivotally connected to the claw-shaped head so that the flexible member can constantly provide force to push the claw-shaped head and slide block into motions; on the other hand, a guide area with special geometric-designed blocks around the slide block can interact with the swing end of the swing lever for motions, and through such interaction, the position of the slide block can be determined, which is at either the first position or the second position; thus, under interaction and control given by the slide block, the claw-shaped head can be actuated so as to fasten or unfasten an object.

Another embodiment of the present invention also includes a friction member fastened inside the outer case, wherein the friction member has a resilient sheet capable of pushing the swing lever towards the guide area of the slide block by its resilience so as to provide friction for preventing the swing lever from making unintentional sway.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
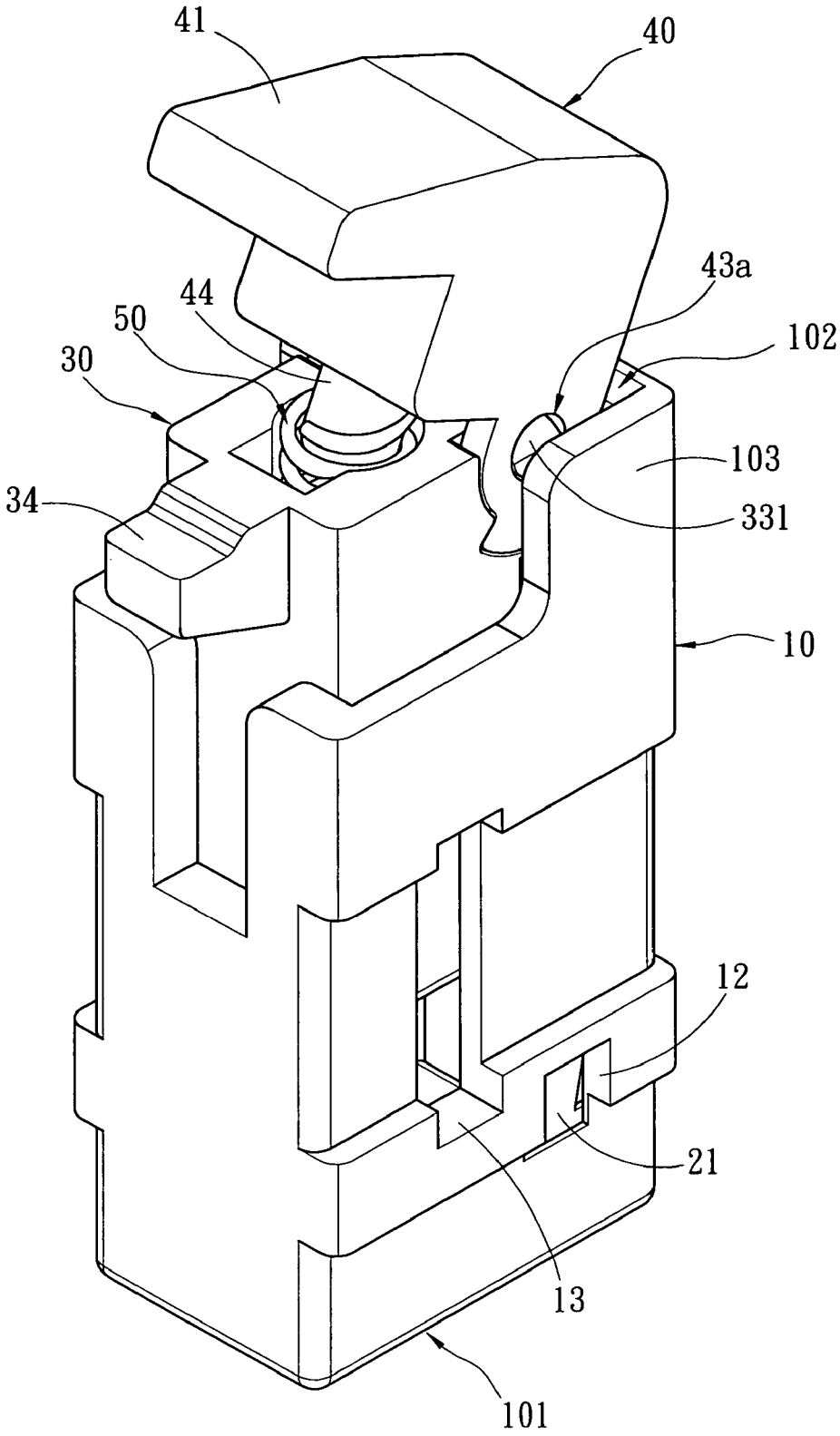
FIG. 1 is a schematic diagram illustrating the structure of one embodiment of the present invention.
Figure 2:
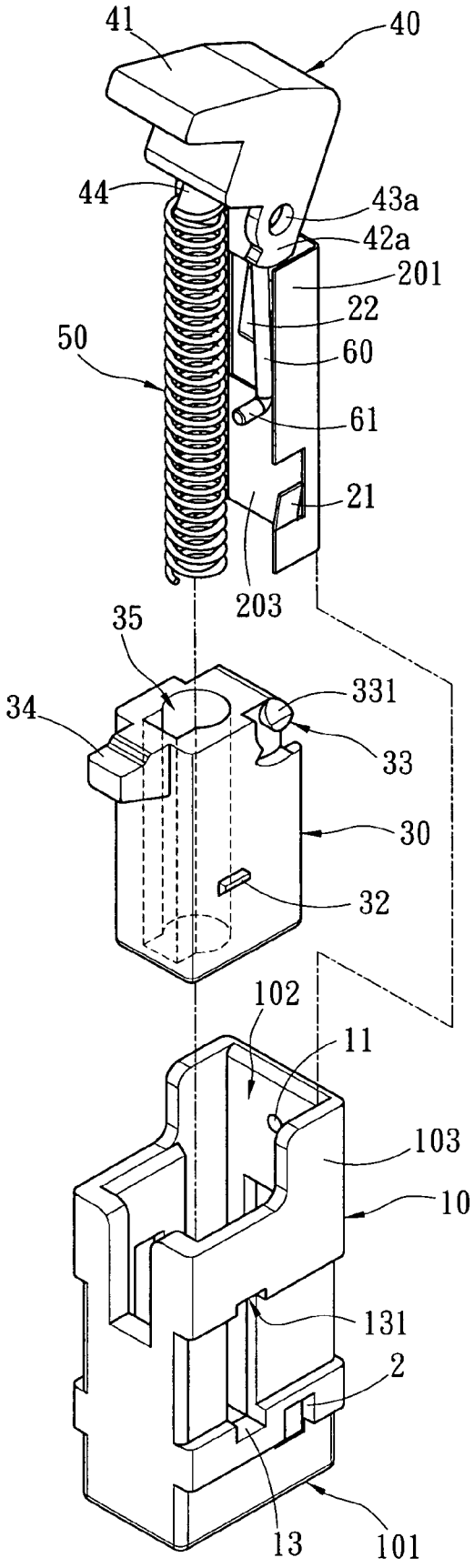
FIG. 2 is an exploded diagram illustrating the structure of one embodiment of the present invention.
Figure 3:
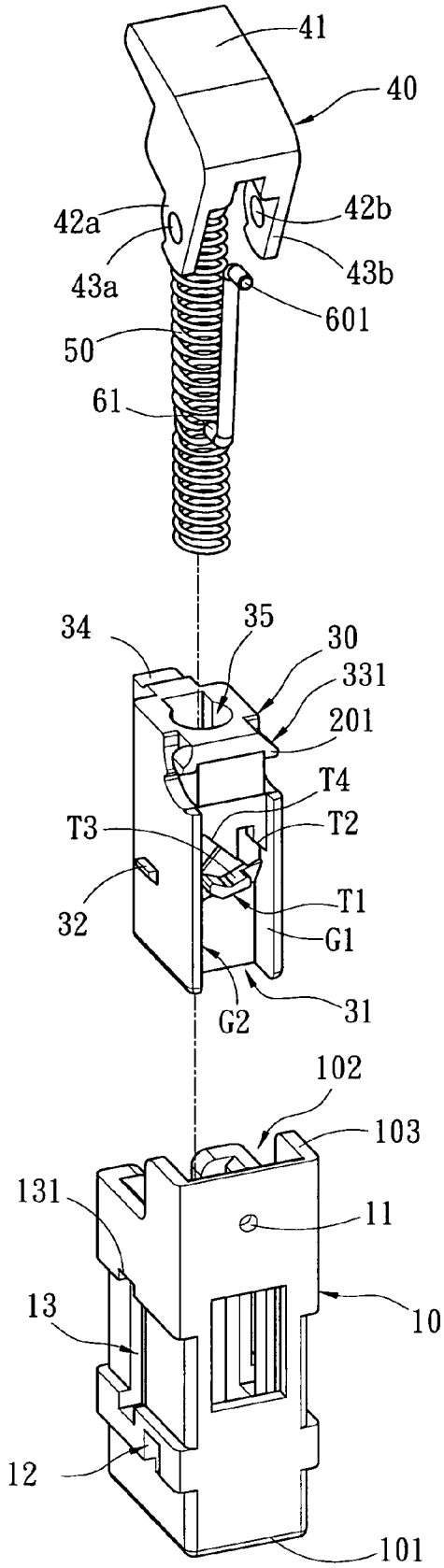
FIG. 3 is an exploded diagram also illustrating the structure of one embodiment of the present invention.

Referring to FIGS. 1, 2, and 3, a fastener with lateral fastening mechanism in one embodiment includes an outer case 10, a slide block 30, a claw-shaped head 40, and a flexible member 50. The detailed description of each component of the embodiment will be described below.

Figure 7:
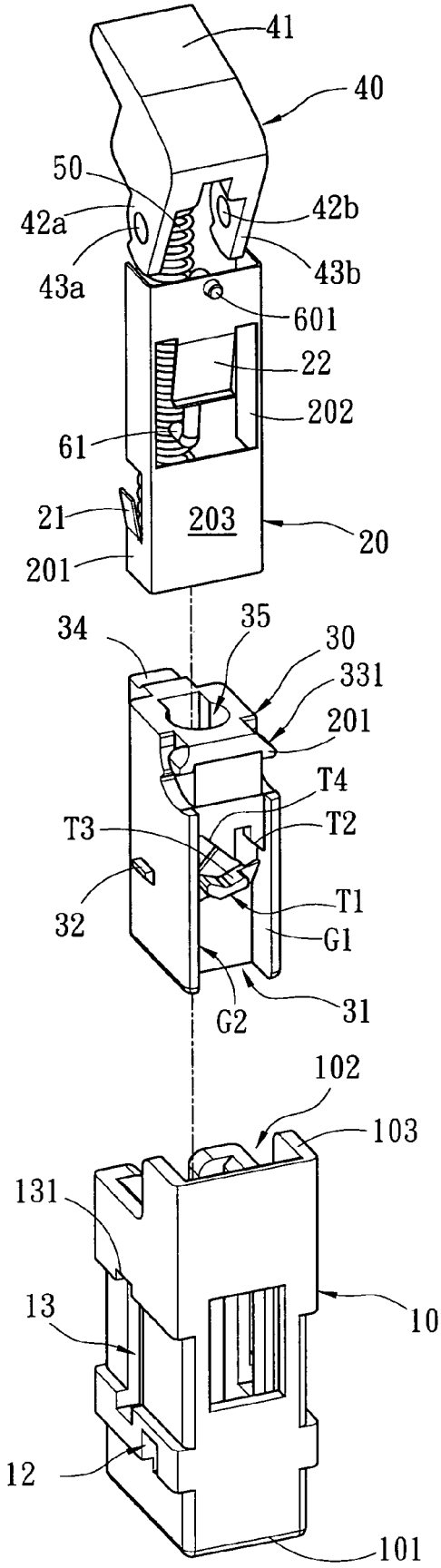
FIG. 7 is an exploded diagram illustrating the structure of one embodiment of the present invention.

Firstly, the outer case 10 is a hollow tubular member, with a closed end 101 closed and an open end 102 open, allowing the slide block 30 to make free in-and-out movement from the open end 102. Also, a swing lever 60 is pivotally connected to an axle hole 11 located inside the outer case 10 and held by a lever axle 601 provided at one end of swing lever 60. Alternatively, the lever axle 601 of swing lever 60 can also be pivotally connected to a wall surface 203, as shown in FIG. 7, which is at one side of friction member 20.

Thus, the swing lever 60 along with the friction member 20 can be placed inside the outer case 10.

Figure 5A:
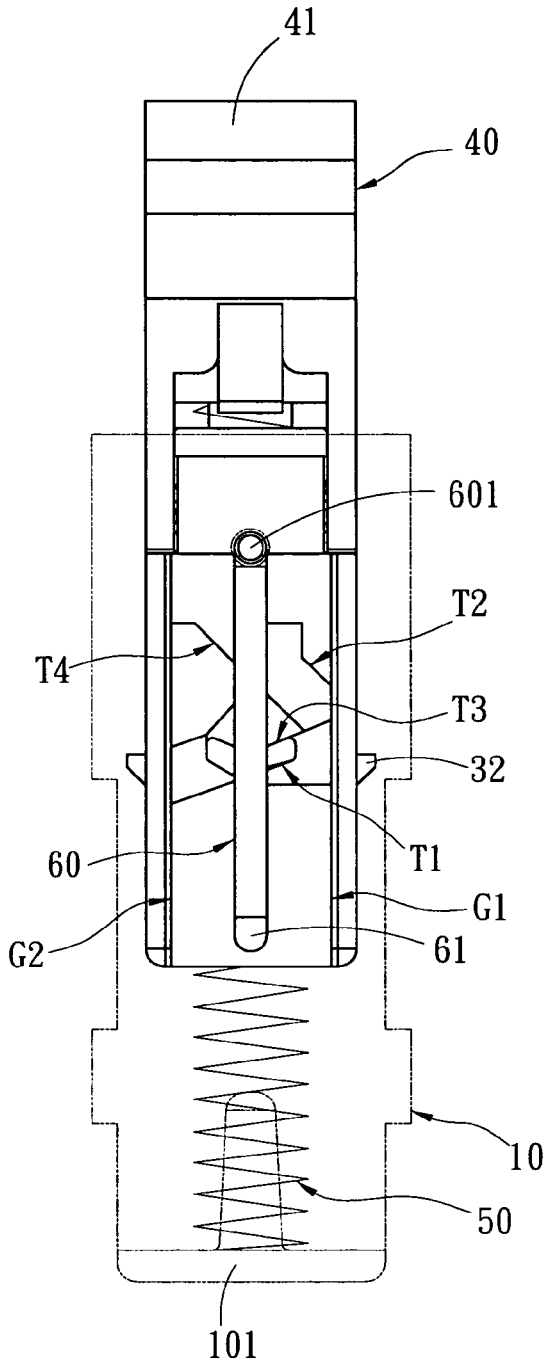
FIGS. 5A to 5F are schematic diagrams illustrating consecutive motions in one embodiment of the present invention.

Secondly, the slide block 30 includes a jutted nose 34, which can be pushed for movement by an object, thereby actuating the slide block 30 for sliding. The slide block 30 can freely slide inside the outer case 10 towards a first position where the slide block 30 is hidden inside the outer case 10, as shown in FIG. 5D, and towards a second position where the slide block 30 sticks out of the outer case, as shown in FIG. 5A. Also, a protruded hook 32 is provided on the outer surface of slide block 30 (in the preferred embodiment, a hook 32 is provided at each of the two opposite outer surfaces of slide block 30). The hook 32 can slide along the track 13 located on the surface of outer case 10. When the slide block 30 is sliding towards the second position, the hook 32 can move along the track 13 to a track end 131 of track 13. By utilizing the track 13, the slide block 30 can be halted without detaching from the outer case 10. Besides, a guide area 31 is located at the same side of swing lever 60 facing the slide block 30, and has special geometric-designed blocks that can interact with the swing end 61 of swing lever 60. When in the state of interaction, the position of slide block 30 can be decided to be at either the first position or the second position. If it is at the first position, the slide block 30 will be confined by the swing end 61 of swing lever 60, maintaining a position hidden inside the outer case 10, whereas if at the second position, the slide block 30 can stick out from the open end 102 of outer case 10.

Figure 6A:
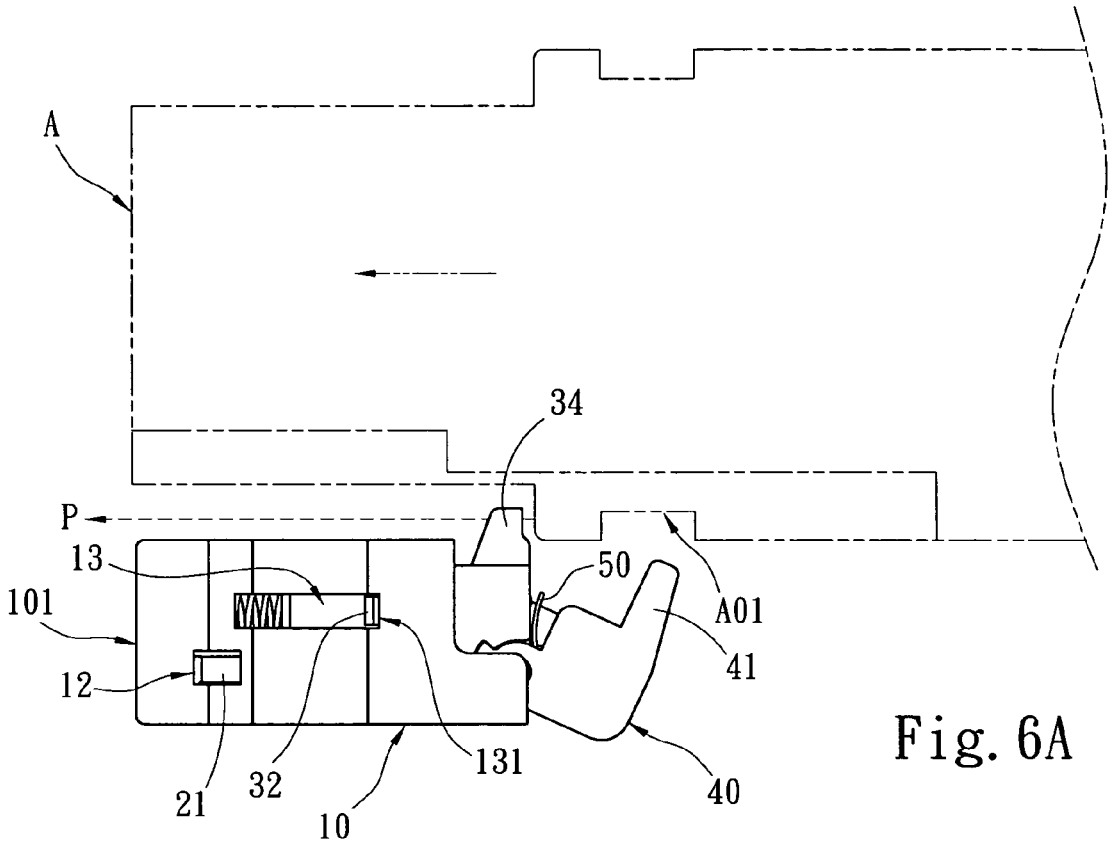
FIGS. 6A and 6B are schematic diagrams illustrating application examples in one embodiment of the present invention.

Thirdly, the claw-shaped head 40 includes a claw portion 41 and a pair of extended arms 42*a* and 42*b*. The extended arms 42*a* and 42*b* have pivot holes 43*a* and 43*b* respectively, and through the pivot holes the extended arms 42*a* and 42*b* can be pivotally connected to the block axle 33. Also, an inclined plane 331 is provided at one end of block axle 33, facing the claw-shaped head 40. Through guidance offered by the inclined plane 331, the extended arms 42*a* and 42*b* can pass easily, allowing the pivot holes 42*a* and 43*b* to be pivotally connected to the block axle 33 of slide block 30. In addition, the claw-shaped head 40 can move freely inside the outer case 10 in accordance with the movement made by the slide block 30. When the slide block 30 is positioned at the second position, the block axle 33 will slightly stick out of the open end 102 of outer case 10, allowing the claw portion 41 of claw-shaped head 40 to move to one side of outer case 10, and in such state, the claw portion 41 can avoid dropping in the path P where the object A waiting to be fastened will meet with the nose 34, as shown in FIG. 6A.

Fourthly, the flexible member 50, a compression spring in the illustrated embodiment, can go freely through a through hole 35 located at the center of slide block 30. One end of flexible member 50 countervails the closed end 101 of outer case 10, whereas the other end of flexible member 50 countervails a fastening bolt 44 located at the inner side of claw portion 41. Thus, the flexible member 50 can constantly provide resilience to push the claw portion 41 of claw-shaped head 40 towards the direction of sticking out of the outer case 10.

Finally, the guide area 31 of slide block 30 includes a plurality of protruded blocks, wherein each protruded block has a shape of specific geometric design. These protruded blocks provide four slanting planes T1, T2, T3, and T4 and two straight guiding lines, the first guiding line G1 and the second guiding line G2. When the slide block 30 is sliding inside the outer case 10, the four slanting planes T1, T2, T3, and T4 and the two guiding lines G1 and G2 can interact with the swing end 61 of swing lever 60 for motion, and during the interaction, the position of slide block 30 can be decided to be at either the first or the second position.

Figure 4:
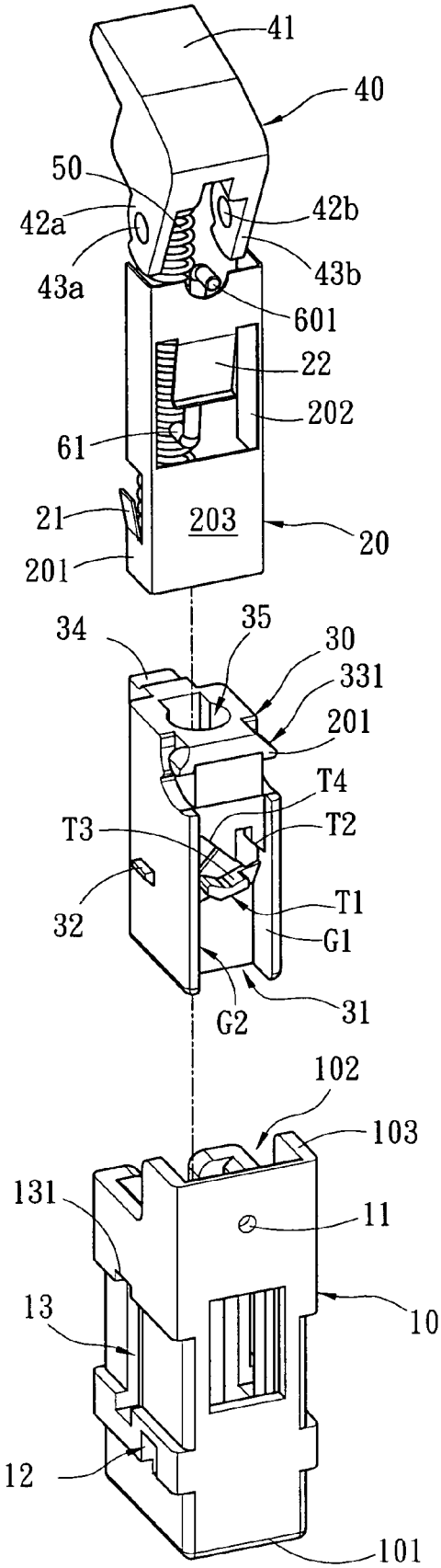
FIG. 4 is an exploded diagram illustrating the structure of another embodiment of the present invention.
Figure 8:
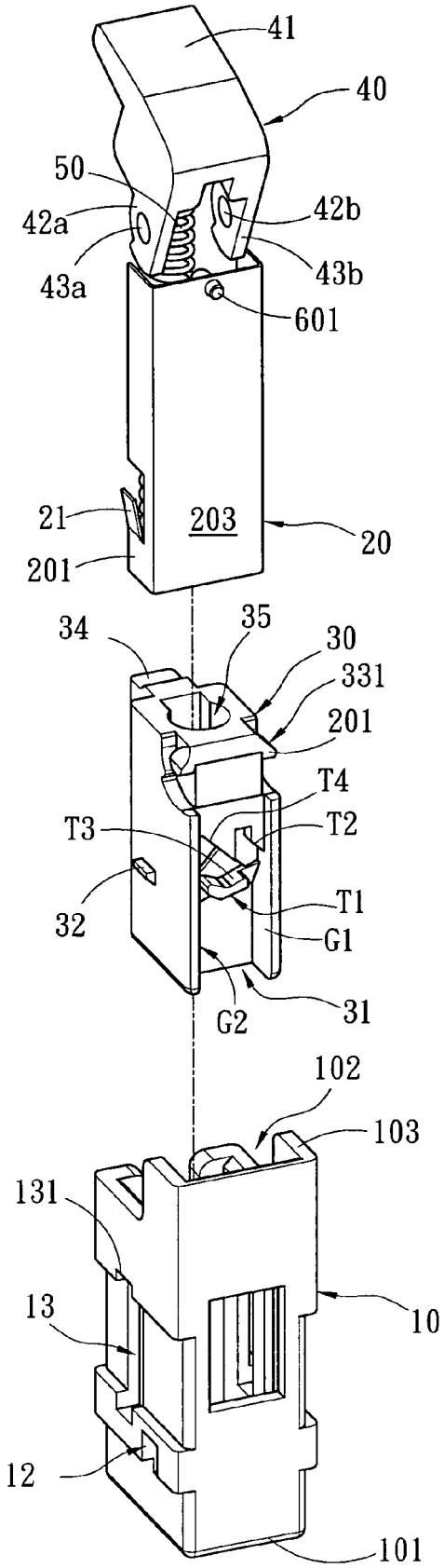
FIG. 8 is an exploded diagram illustrating the structure of one embodiment of the present invention.

Referring to FIG. 4, in another embodiment of the present invention, a friction member 20 is also included in the embodiment, which is formed by three long thin slats 201, 202, and 203. In this embodiment, the friction member 20 is made of thin metal sheet and located inside the outer case 10, smoothly attached to the inner wall of outer case 10. Besides, a fastening anchor 21 is also included in the friction member 20, fastened into an anchor hole 12 located on the wall of outer case 10. Furthermore, the friction member 20 can also has a resilient sheet 22, which can constantly generate friction for pushing the swing lever 60 towards the guide area 31 of slide block 30 so as to prevent the swing lever 60 from making unintentional sway. However, in embodiment other than this one, the resilient sheet 22 can alternatively be excluded from the friction member 20, as shown in FIG. 8.

Next, referring to FIGS. 5A to 5F, in which FIG. 5A illustrates the slide block 30 being positioned at the second position for a sticking-out situation, the flexible member 50 under such circumstances will push the claw portion 41 of claw-shaped head 40 towards the open end 102 of outer case 10. On the other hand, the slide block 30 will slide correspondingly to the claw portion 40 and stop at the second position. Meanwhile, the claw portion 41 can avoid dropping in the path P where the object A will meet with the nose 34, as shown in FIG. 6A.

Figure 5B:
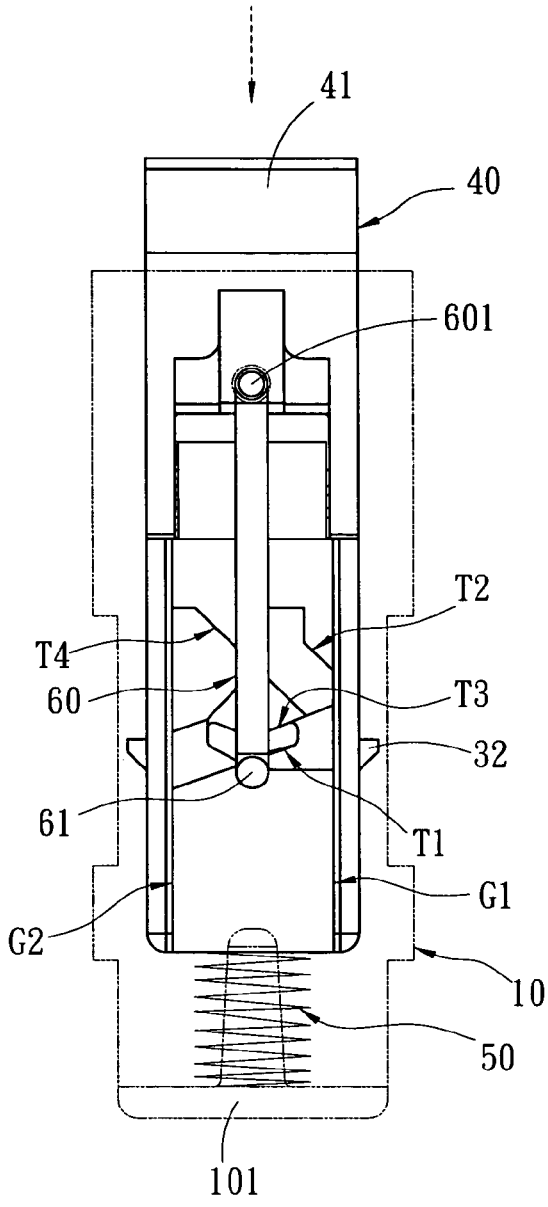

When the object A moves toward the nose 34 along the path P and meets with the nose 34, as shown in FIG. 5B, the slide block 30 will slide towards the closed end 101 of outer case 10. Under this circumstance, the swing end 61 of swing lever 60 will move closer to the first slanting plane T1 correspondingly, and then through guidance offered by the first slanting plane T1, the swing end 61 will be pushed toward the first guiding line G1.

Figure 5C:
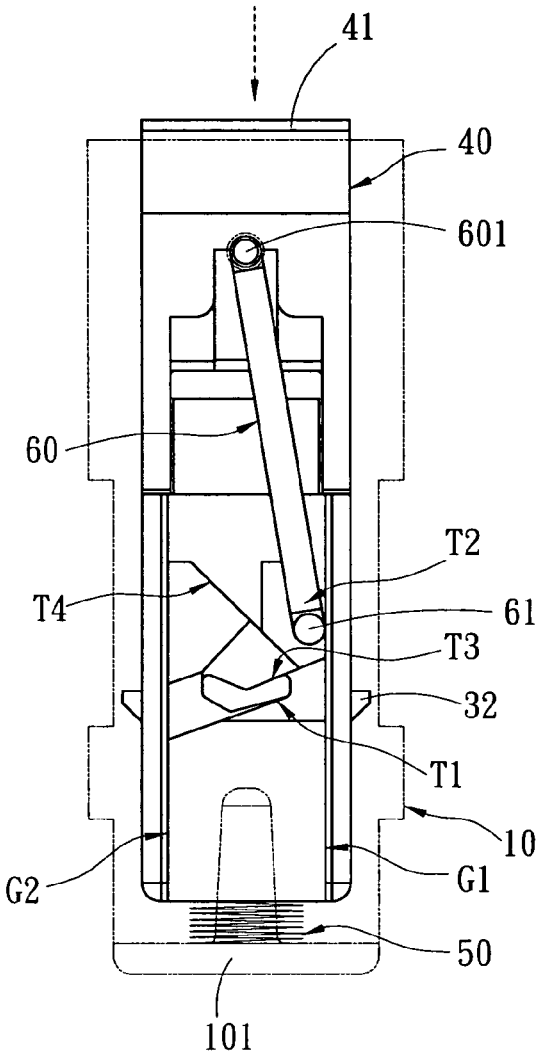
Figure 5D:
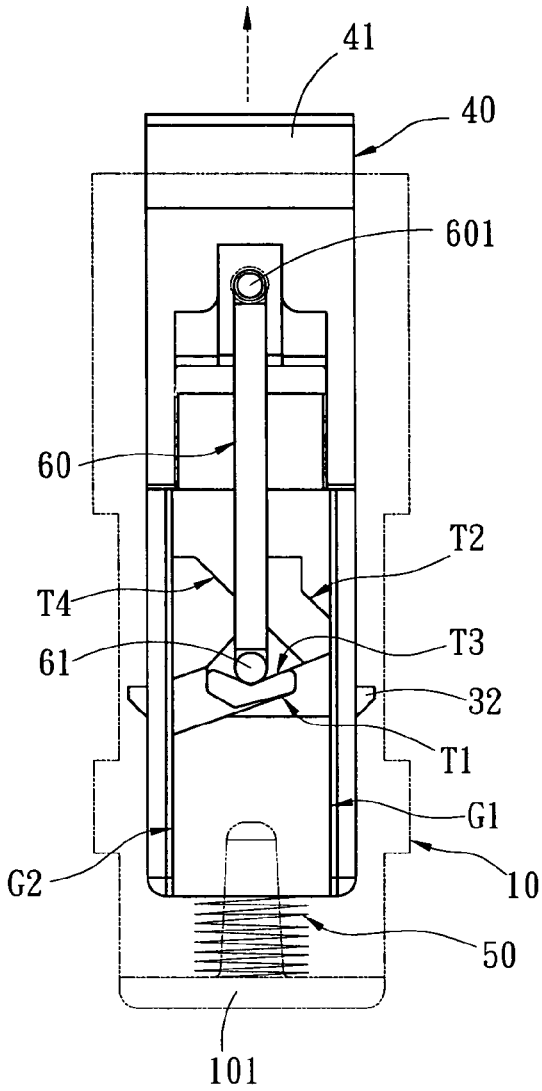
Figure 6B:
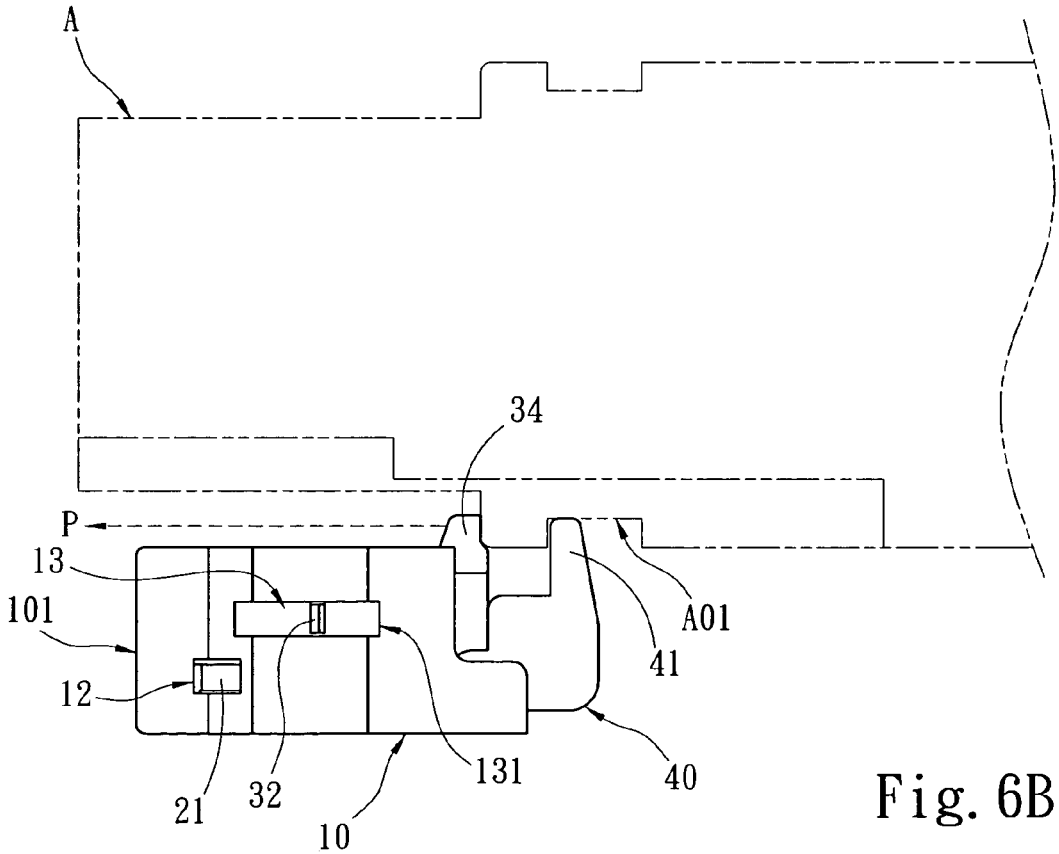

As the slide block 30 moves towards the closed end 101 of outer case 10, the claw-shaped head 40 will be actuated, moving correspondingly into the inside of outer case 10. As soon as the claw-shaped head 40 slides into the open end 102 of outer case 10, the claw-shaped head 40 will be guided by a top-ending rim 103 formed by three adjacent top-ending portions along the rim of open end 102 and moves towards the nose 34 by using the block axle 33 as its center, followed by an act of clamping, as shown in FIG. 6B. Therefore, the object A can be fastened at a recess A01 at one side of object A with the help of claw portion 41 and nose 34. During the aforementioned process, the swing end 61 of swing lever 60 will move towards the center of guide area 31 of slide block 30 through guidance offered by the second slanting plane T2, as shown in FIG. 5C. Once if pushing force generated by the object A for pushing the nose 34 and slide block 30 disappears, the flexible member 50 will generate counterforce, allowing the slide block 30 to slide in an opposite direction towards the open end 102 of outer case 10. Meanwhile, the V-shaped third slanting plane T3, located at the center of guide area 31 of slide block 30, will countervail the swing end 61 of swing lever 60 again, halting the on-going sliding movement of slide block 30 towards the open end 102 of outer case 10, and hence the slide block 30 can remain at the first position hidden inside the outer case 10, as shown in FIG. 5D.

Figure 5E:
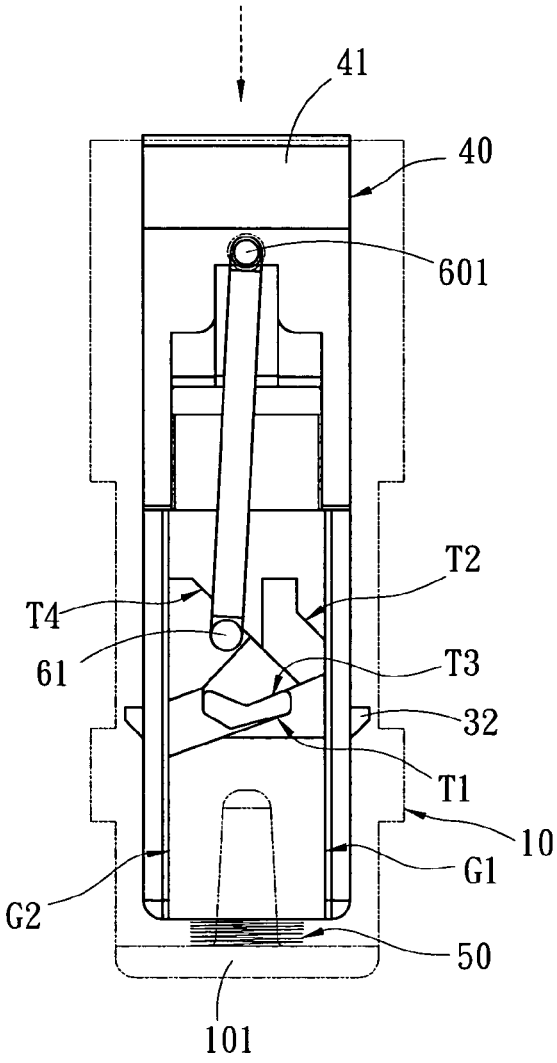
Figure 5F:
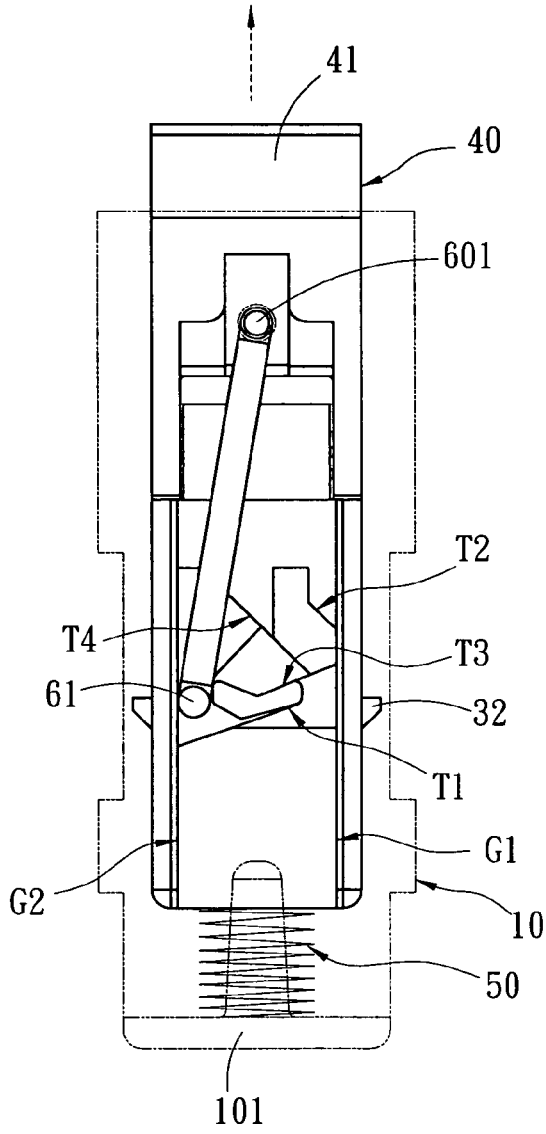

Afterwards, when the object A is to be withdrawn, the only thing need to do is to push the object A towards the closed end 101 of outer case 10. By doing so, the slide block 30 can be actuated and begin to slide in the same direction. Meanwhile, the swing end 61 of swing lever 60 will move closer to the fourth slanting plane T4. As the slide block 30 keeps the on-going movement, the fourth slanting plane T4 will guide the swing end 61 of swing lever 60 towards the edge of guide area 31 of slide block 30, as shown in FIG. 5E, and arrive at the edge of second guiding line G2. Then, as the sliding block 30 keeps on sliding, the swing end 61 of swing lever 60 will go back to the second position through guidance offered by the second guiding line G2, as shown in FIGS. 5A and 5F. Similarly, by repeating the above-mentioned operation, the swing end 61 of swing lever 60 will again interact with the four slanting planes T1, T2, T3, and T4 and two straight guiding lines G1 and G2. When in the state of interaction, the position of sliding block 30 can be decided to be at either the first or the second position. Finally, during the above-mentioned process, since the resilient sheet 22 can constantly push the swing lever 60 toward the guide area 31 of slide block 30, the swing lever 60 can be prevented from loosening or unintentional swaying by means of friction made between the resilient sheet 22 and the swing lever 60, so that the swing lever 60 can be prevented from moving to an inappropriate position for malfunction.

The embodiments above are only intended to illustrate the present invention; they do not, however, to limit the present invention to the specific embodiments. Accordingly, various modifications and changes may be made without departing from the spirit and scope of the present invention as described in the following claims.

What is claimed is:

1. A fastener with a lateral fastening mechanism, suitable for fastening an object from the lateral side of the object, including:

an outer case and a pivotally connected swing lever, the outer case being a hollow tubular member with an open end, and the pivotally connected swing lever being provided inside the outer case and having one end connected to the outer case and the other end being a swing end capable of making sway motions;

a slide block having a nose located at a path of the object, wherein the nose is pushed by the object for a corresponding movement so that, when in a state of movement, a slide block is actuated and capable of sliding freely inside the outer case towards a first position and a second position; the slide block remaining hidden inside the outer case when at the first position, due to being confined by the swing end of the swing lever, and the slide block sticking out of the outer case from its open end when at the second position; wherein a guide area with special geometric-design blocks is provided at a side facing the swing lever so that the guide area interacts with the swing end of the swing lever for motions, so that, when in the state of interaction, the position of the slide block is selected from either the first position or the second position;

a claw-shaped head being pivotally connected to the slide block and capable of freely moving inside the outer case along with the sliding movement of the slide block; and a flexible member, which freely goes through the center of the slide block and constantly provide resilience to push the claw-shaped head towards the open end so that it sticks out of the outer case; wherein, when the claw-shaped head actuates the slide block and arrives at the second position, the claw portion avoids being dropped in the path where the object and the nose will meet; and wherein, when the slide block and the claw-shaped head move towards the inside of the outer case through mutual actuation and arrive at the first position, the claw-shaped head will slide towards the open end of the outer case and make a swaying movement by using the pivot point as its center, wherein the pivot point allows the claw-shaped head to be pivotally connected to the slide block; wherein the swaying movement allows the claw portion to move towards the nose and perform a clamping operation at the lateral side of the object, wherein a protruded hook is provided at an outer surface of the slide block, the protruded hook being capable of sliding along a track provided at a surface of the outer case, wherein, when the slide block slides to the second position, the hook moves to one end of the track, so as to utilize the track to prevent the slide block from detaching from the outer case.

2. The fastener with a lateral fastening mechanism as claimed in claim 1, wherein one end of the swing lever is pivotally connected to the outer case.

3. The fastener with a lateral fastening mechanism as claimed in claim 1, wherein a friction member is further provided inside the outer case, the friction member being smoothly attached to the inner wall of the outer case and having a fastening anchor for fastening an anchor hole on the wall of the outer case.

4. The fastener with a lateral fastening mechanism as claimed in claim 3, wherein one end of the swing lever is pivotally connected to the function member.

5. The fastener with a lateral fastening mechanism as claimed in claim 3, wherein the friction member has a resilient sheet that constantly pushes against the swing lever.

6. The fastener with a lateral fastening mechanism as claimed in claim 1, wherein the claw-shaped head is pivotally connected to an axle protruding from two sides of the slide block, the claw-shaped head having a pair of extended arms, each extended arm containing a pivot hole respectively; through which the extended arms are pivotally connected to the axle of the slide block.

7. The fastener with a lateral fastening mechanism as claimed in claim 1, wherein the flexible member is a compression spring.

8. The fastener with a lateral fastening mechanism as claimed in claim 1, wherein the outer case is a hollow tubular member with one end open and the other end closed, one end of the flexible member countervailing the closed end and the other end of the flexible member countervailing the inner side of the claw portion.

9. The fastener with a lateral fastening mechanism as claimed in claim 1, wherein the open end of the outer case has a top-ending rim formed by three adjacent top-ending portions along the rim of the open end, so that, when the claw-shaped head is actuated by the slide block and moves towards the first position, the top-ending rim guides the claw-shaped head to make sway movement by using the pivot point as its center, the pivot point allowing the claw-shaped head to be pivotally connected to the slide block, so that the claw portion moves towards the nose and performs a clamping operation at the lateral side of the object.

10. The fastener with a lateral fastening mechanism as claimed in claim 1, wherein the guide area has a plurality of protruded blacks of special geometric-designed shapes, including four slanting planes and two straight edge-lines, including the first guiding line and the second guiding line.

11. The fastener with a lateral fastening mechanism as claimed in claim 10, wherein, when the slide block moves towards the first position, the first slanting plane is used to guide the swing end of the swing lever to move towards the direction of the first guiding line.

12. The fastener with a lateral fastening mechanism as claimed in claim 11, wherein, when the slide block continues to move towards the first position, the second slanting plane guides the swing end of the swing lever to move towards the center of the guide area of the slide block.

13. The fastener with a lateral fastening mechanism as claimed in claim 12, wherein, when the slide block slides towards the open end of the outer case, the swing end of the swing lever countervails the V-shaped third slanting plane located at the center of the guide area so as to stop the slide block from continuously moving towards the open end of the outer case, thereby allowing the slide block to remain at the first position.

14. The fastener with a lateral fastening mechanism as claimed in claim 13, wherein, when the slide block moves in a direction opposite to the open end of the outer case, the swing end of the swing lever correspondingly moves towards the fourth slanting plane, whereby the fourth slanting plane guides the swing end of the swing lever to move towards the edge of the guide area and reach the second guiding line.

15. The fastener with a lateral fastening mechanism as claimed in claim 14, wherein, when the slide block moves towards the open end of the outer case, the swing end of the swing lever goes back to the second position through guidance offered by the second guiding line.

* * * * *